US006820949B1

(12) United States Patent
Caruso

(10) Patent No.: US 6,820,949 B1
(45) Date of Patent: Nov. 23, 2004

(54) FURNITURE NESTING TECHNOLOGY

(76) Inventor: Steven Jerome Caruso, 862 Pine Hill Dr., Antioch, IL (US) 60002

( * ) Notice: Subject to any disclaimer, the term of this patent is extended or adjusted under 35 U.S.C. 154(b) by 28 days.

(21) Appl. No.: 10/222,443

(22) Filed: Aug. 17, 2002

Related U.S. Application Data

(60) Provisional application No. 60/313,929, filed on Aug. 21, 2001.

(51) Int. Cl.[7] ..... A47B 87/00

(52) U.S. Cl. ..... 312/107; 108/91

(58) Field of Search ..... 211/134; 108/91, 108/108; 213/235.1, 107

(56) References Cited

U.S. PATENT DOCUMENTS 1,588,771 A * 6/1926 Richardson ..... 312/201
2,555,178 A * 5/1951 Young ..... 312/249.8
2,563,436 A * 8/1951 Toth ..... 182/33.5
3,756,680 A * 9/1973 Lerner ..... 312/237
3,916,802 A * 11/1975 Virtue et al. ..... 108/27
4,102,275 A * 7/1978 Spound et al. ..... 108/92
4,450,968 A * 5/1984 Muellner ..... 211/17
D288,996 S * 3/1987 Winzeler, III ..... D6/474
6,230,909 B1 * 5/2001 Suter ..... 211/188
6,238,758 B1 * 5/2001 Lin ..... 428/36.9
D445,281 S * 7/2001 Tsong-Yow ..... D6/449
D447,891 S * 9/2001 Wood et al. ..... D6/480

* cited by examiner

*Primary Examiner*—Janet M. Wilkens
(74) *Attorney, Agent, or Firm*—McAndrews, Held & Malloy, Ltd.

(57) ABSTRACT

A new way to store furniture is provided: a first piece of furniture that nests with a second piece of furniture. One of these pieces of furniture may be a step stool or a storage structure. The two pieces fit or nest together, preserving their individual functionality, and at the same time yielding a desirable aesthetic and stowing one of the pieces of furniture when it is not needed.

23 Claims, 15 Drawing Sheets

FURNITURE NESTING TECHNOLOGY

This application claims the benefit of U.S. Provisional Application No. 60/313,929 filed Aug. 21, 2001.

FIELD OF THE INVENTION

The present invention relates generally to a novel way to store a step stool or another occasionally used furniture item. Step stools are commonly used around the home and in businesses, but they are often difficult to store when not needed. Other types of furniture, such as a table or shelving unit are often only needed temporarily when additional storage or work surfaces are desired. These items are also difficult to store while they are not being actively used.

BACKGROUND OF THE INVENTION

In the art of step stool manufacture, several styles arc made available. These range from folding styles to styles that are non-folding, and others that in one way or another transform into another article of furniture such as a chair. None of these approaches result in a satisfactory unit that is easily and readily accessible, stable, and not compromised in some other way. Additionally, it is often desirable to have additional storage or work surfaces temporarily available, and yet be able to store them in an easy and efficient manner when they are not needed. The solutions to date are limiting.

As previously stated, step stools come in a variety of styles, but all of these fall short in some aspect or another. Much of this can be attributed to the storage problem of these units. Step stools that don't fold are the most obvious problem products, being the most difficult to store. However, they do have several advantages over foldable units such as superior stability, and they don't have to be unfolded to be in an in use position. Step stools that do fold reduce the amount of space that it takes to store them, but they still use valuable storage space, are aesthetically unpleasing, and are inherently not as stable as a static, non-folding ladder. There are also so those that are intended to serve another function in addition to being a step stool, such as a combination step stool/garbage can. The problem with this particular approach is that the user has to carry his garbage around with the stool, every lime it is to be used in another location. Step stools that convert into a chair have been popular, however aesthetically they look like a step stool that has been converted to a chair, and they also sit look like a step stool that has been converted to a chair. And so those that try to serve another function in addition to being a step stool result in a compromise of form and function of both uses.

There have also been tables that nest together. However, the solutions to date have been limited in that a single level for each of the tables has been used, and the topmost surface of the shorter table has had to be lower than the lowest shelf of the larger table it is to be nested with.

SUMMARY OF THE INVENTION

This invention addresses the shortcoming of other approaches by integrating a step stool, or other piece of furniture, with another piece of furniture. The two pieces fit, or nest together, preserving their individual functionality, and at the same time yielding a desirable aesthetic. Such a stool may of the folding variety, or of the non-folding static style. Additionally, this invention can be configured so that a second table/storage surface may act as the already mentioned step stool, and so two pieces of furniture may be nested and stowed when the second table/storage surface is not needed.

BRIEF DESCRIPTION OF THE DRAWINGS

Referring now to the figures.

The following reference characters are used in the drawings to refer to the parts of the present invention. Like reference characters indicate like or corresponding parts in the respective views.

2—Side member of table/shelving system.
4—Top shelving/table surface.
6—Lower shelving/table surface.
8—Shelf foot.

10—Cross support of table/shelving system.
12—Side member of step-stool/ladder
14—Cross support of step-stool/ladder
16—Tread surface of step-stool/ladder
17—Assembled step-stool/ladder
18—Vertical clearance slot
19—Assembled table/shelving system
20—Drawer units
22—Stop
24—Slide block member
26—Slide rail
28—Drawer support member
30—Bearing-stop members
32—Foot
34—Limit stop

DETAILED DESCRIPTION OF THE INVENTION

While the invention will be described in connection with several preferred embodiments, it will be understood that the invention is not limited to these embodiments. On the contrary, the invention includes all alternatives, modifications, and equivalents as may be included within the spirit and scope of the forthcoming claims.

Figure 15:
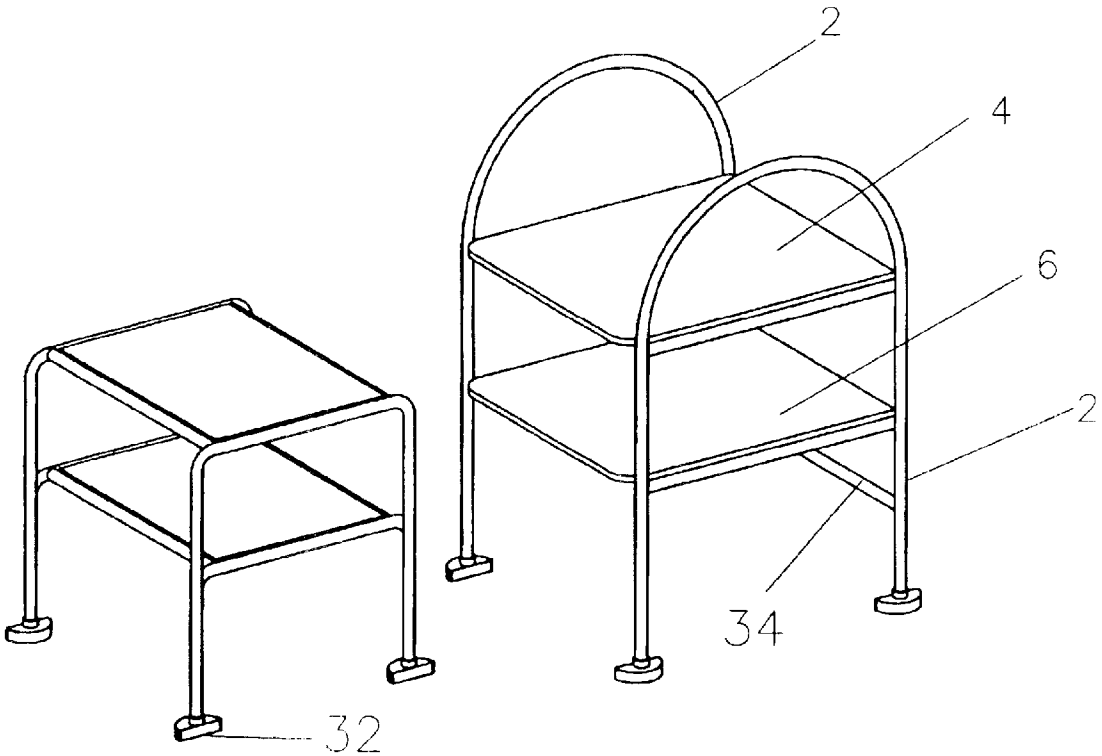
FIG. 15 is a trimetric view of another contemplated embodiment showing the relative positions of the first table or shelving system of the invention and the second table or shelving system of the invention before stowage of the second table or shelving system into the first table or shelving system of the invention.

Also while much of the specification is directed at nesting a step stool with another piece of furniture, as previously mentioned, other options are anticipated. One such option is that the steps of all the step stools discussed may be extended so that what was a step stool is now another piece of storage furniture such as another table that may have more than one tier. FIG. 15 depicts such a situation. Unlike any solution to date the topmost surface of this second piece of storage furniture (referred to as a step-stool or ladder in the remainder of the disclosure) may be higher than the lowermost horizontal surface of the first piece (referred to as a table or drawer unit in the remainder of the disclosure) And so, all the embodiments and options that illustrate a step stool as being the second structure to be stowed, are also directed at another storage structure that can be stored when it is not needed.

Figure 1:
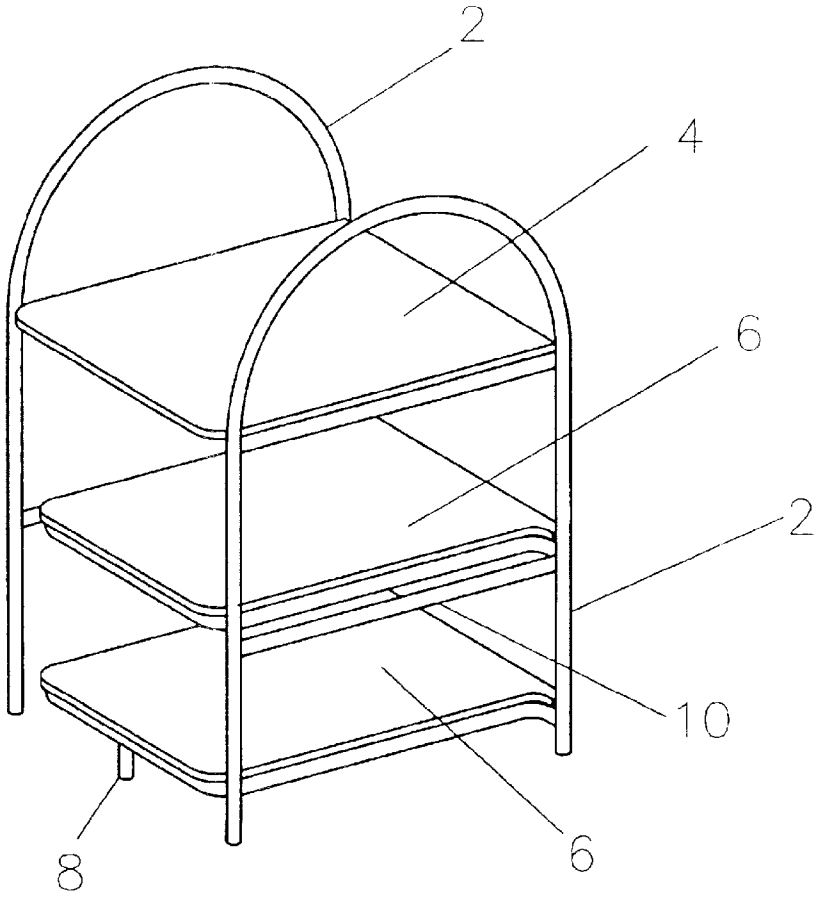
FIG. 1 is a trimetric view of the table or shelving system of the invention.

Referring now to FIGS. 1–6 another embodiment of the present invention is illustrated. FIG. 1 shows one form of the table or shelving system considered. It is primarily constructed of shelves 4 and 6 and a support structure for the shelves 2. The support structure could take many forms. A wire or tubular form is depicted in the drawings, however it can just as easily be more closed-sided through the use of a slab sided construction of wood, plastic, steel etc. Of note is that the two lower shelves 6 are cantilevered a given distance relative to the support structure sides 2. This can be seen better by referring to the exploded view of FIG. 3. This results in a shelf that does not have to extend the full width of the span between the two side support structures 2. This further allows a clearance or slot to occur between the shelves 6, and the support structures 2. The reason for this will become clear after reviewing FIGS. 2–6.

Figure 2:
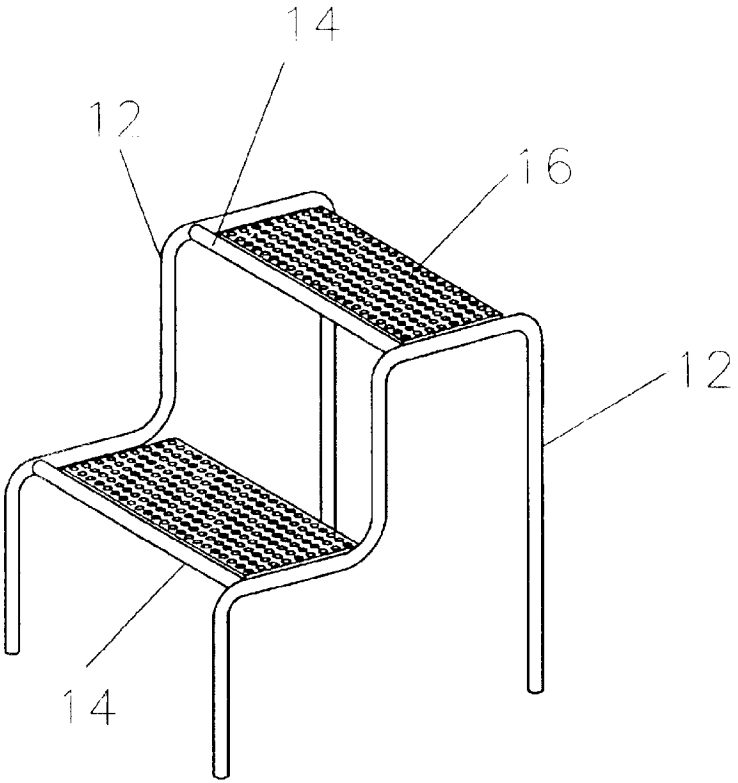
FIG. 2 is a trimetric view of the step stool or ladder of the invention.

Referring to FIG. 2, a basic step stool construction can be seen. The assembly is basically constructed of side members 12 and foot treads 16. This basic construction also can be seen by referring to the exploded view of FIG. 4.

Figure 3:
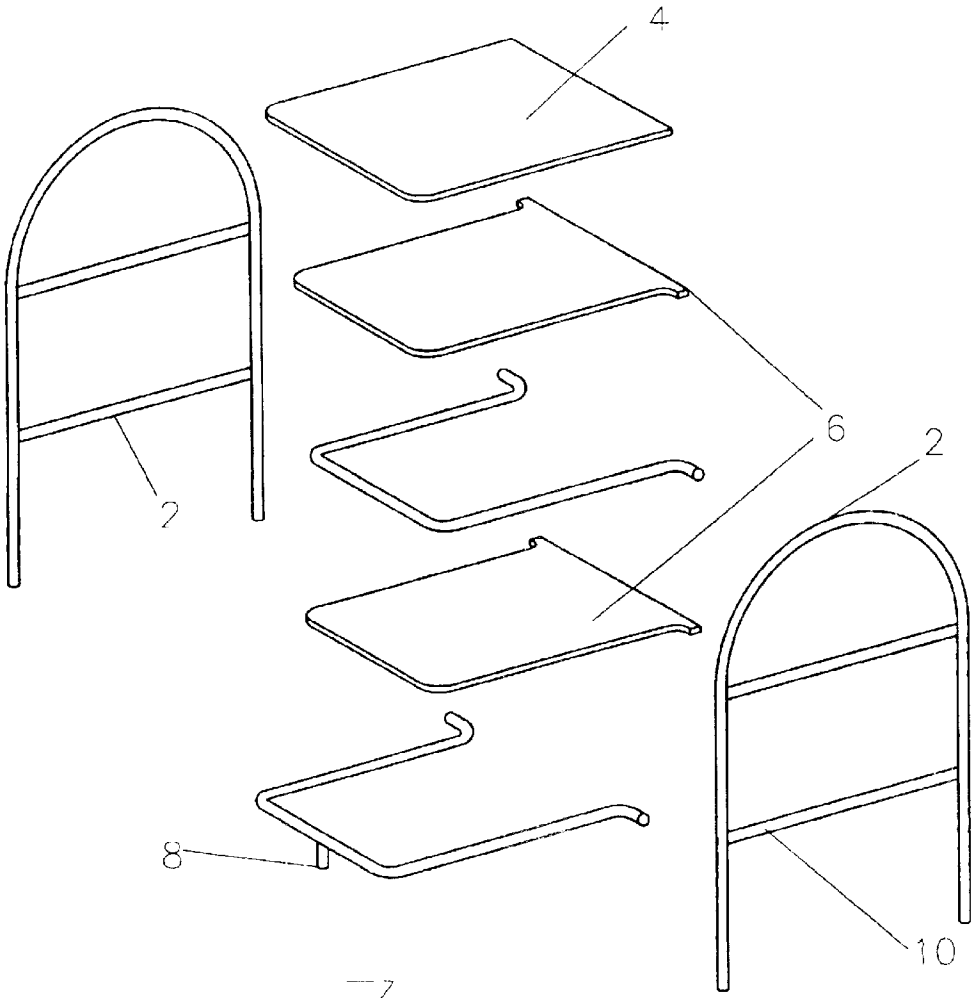
FIG. 3 is a trimetric exploded view of the table or shelving system of the invention.
Figure 4:
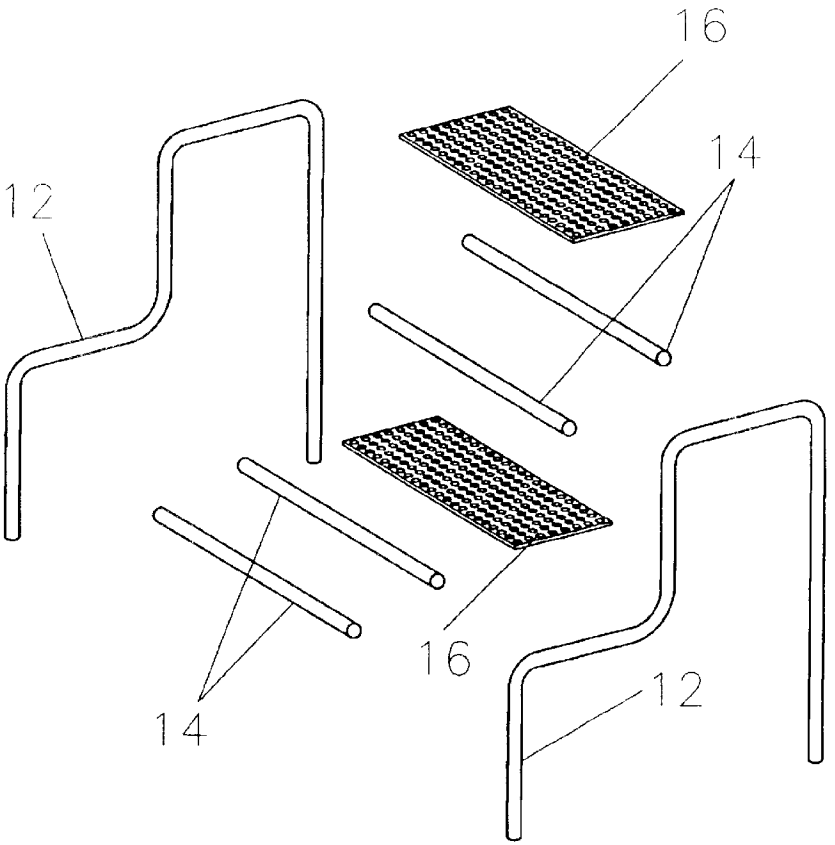
FIG. 4 is a trimetric exploded view of the step stool or ladder of the invention.
Figure 5:
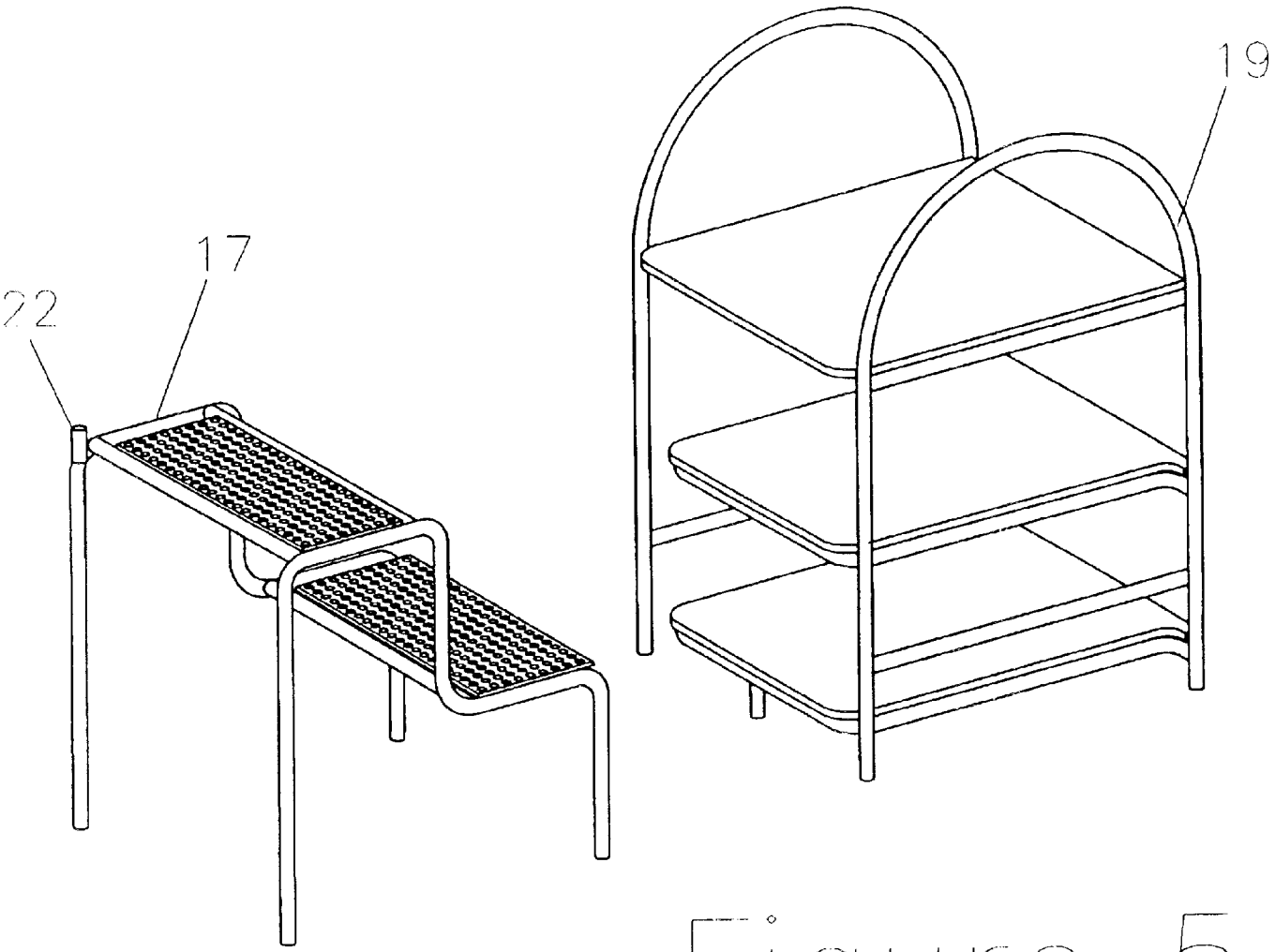
FIG. 5 is a trimetric view of one contemplated one embodiment showing the relative positions of the step stool or ladder of the invention and the table or shelving system of the invention before stowage of the step-stool ladder.

Referring to FIG. 5, the stool of FIGS. 2 and 4 is in position to be stowed within the table/shelving structure of FIGS. 1 and 3.

Figure 6:
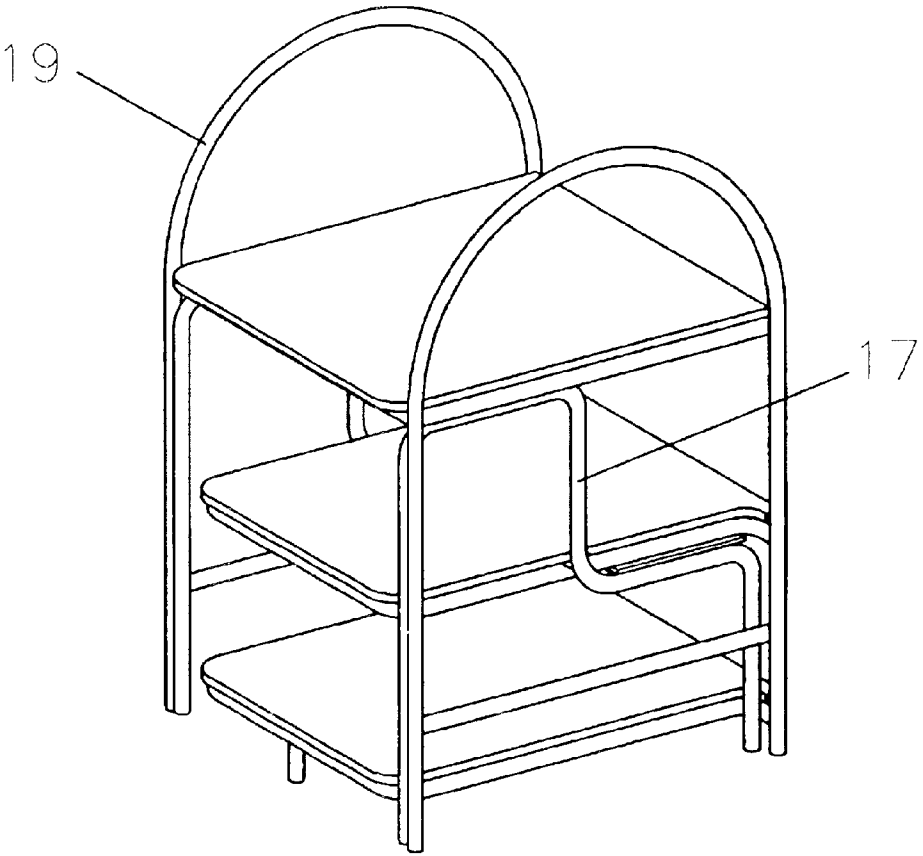
FIG. 6 is a trimetric view showing the elements of FIG. 5—the table/shelving system and the step-stool/ladder—with the step stool/ladder in a stowed or out of use position.

FIG. 6 shows the stool of FIGS. 2 and 4 in a stowed position within the table/shelving structure of FIGS. 1 and 3. The side support structures 12 of the foot stool, fit into the clearance or slot of the table shelving system, and the foot treads 16 fit below the shelf table surfaces 4 and 6 of the table/shelf.

Now that the basic function of the invention is understood, some of the features will be discussed. Still referring to FIG. 6 the step stool/ladder 17 is shown with its lowest step going into the front of the table-shelving system 19. This is but one preferred mode of stowage. In the first scenario, the step stool 17 can be grasped easily by reaching under the appropriate shelf of the table-shelving unit 19. Also, an interference stop can be provided, indicated generally by 22 in FIG. 5, so the user predictably knows where to grasp the step-stool ladder unit when it is to be used. (It should be noted that the stop could be placed in several locations.) However, if no intermediate stop is provided, the step stool could also be stowed with the top step going in first. This has the advantage of allowing the stool to be stowed in either orientation. In this case, a final stop can be provided so that when the step stool is pushed fully in, everything lines up, and the step stool doesn't "overshoot" the storage unit. Such a stop, as indicated in most of the illustrations, could be provided by the attachment point of the shelves or an appropriately placed structural crossbar or other protruding feature appropriately placed on either or both of the structures.

Figure 7:
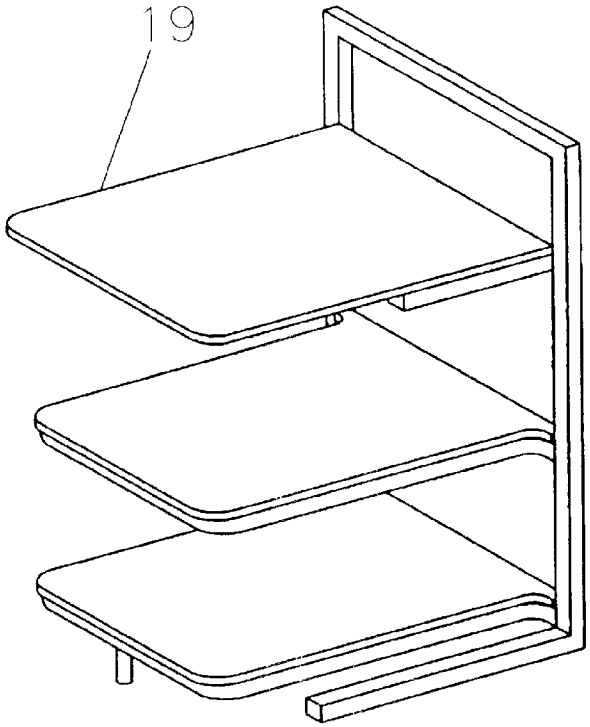
FIG. 7 is a trimetric view of another contemplated embodiment showing the relative positions of the step stool or ladder of the invention and the table or shelving system of the invention before stowage of the step-stool ladder.
Figure 7:
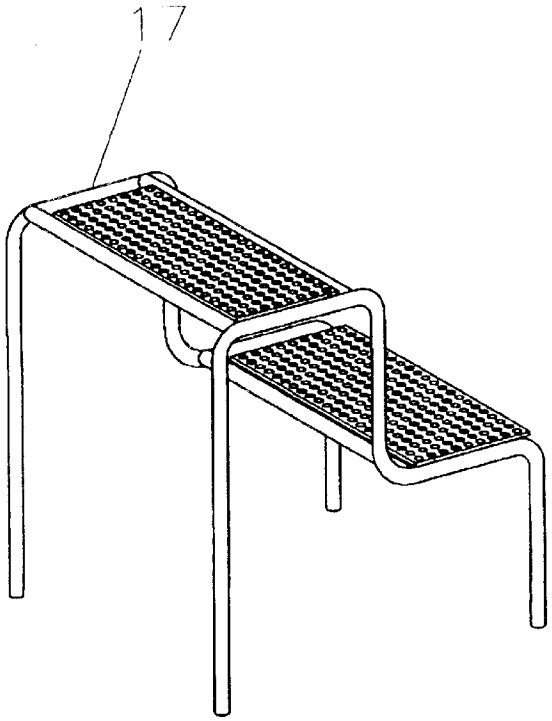
Figure 8:
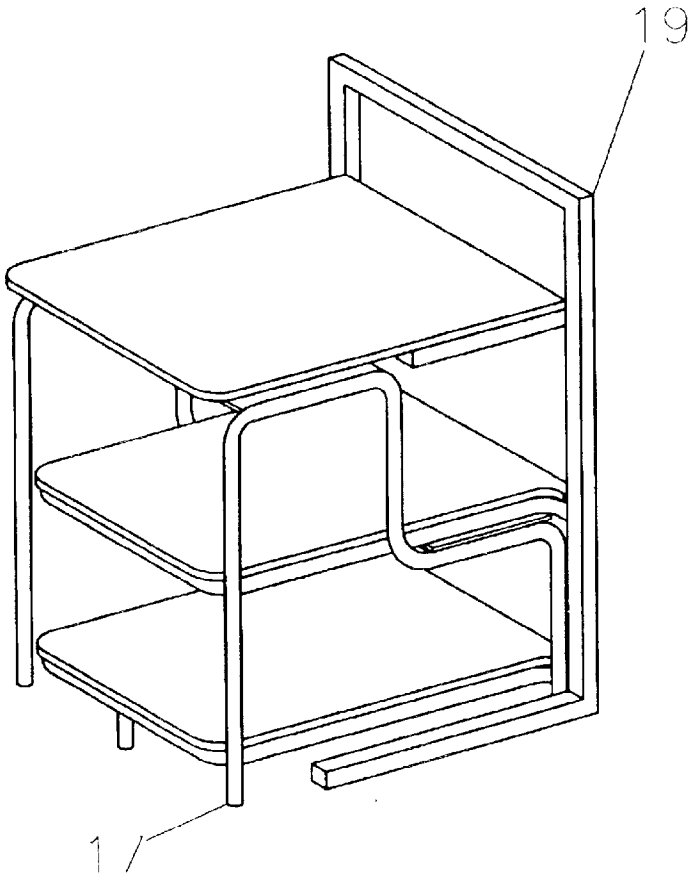
FIG. 8 is a trimetric view showing the elements of FIG. 7—the table/shelving system and the step-stool/ladder—with the step stool/ladder in a stowed or out of use position.

Referring to FIG. 7, the shelves are cantilevered from a rear support structure in this embodiment, so no side support structure per se is needed, However the step-stool/ladder still fits about and under the shelves as can be seen in FIG. 8.

Figure 9:
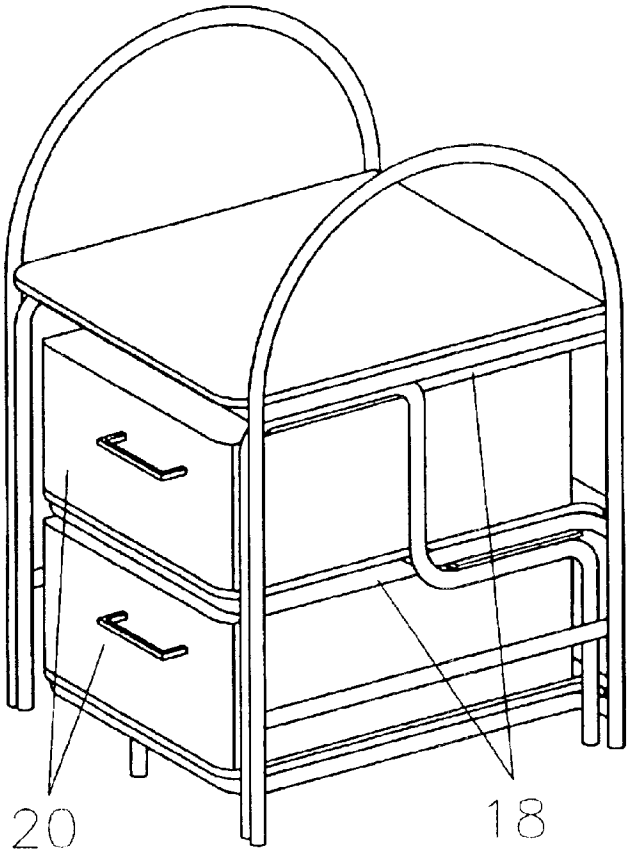
FIG. 9 is a trimetric view of another contemplated embodiment showing the relative positions of the step stool or ladder of the invention and the table or shelving system of the invention with the step stool/ladder in a stowed or out of use position.
Figure 14:
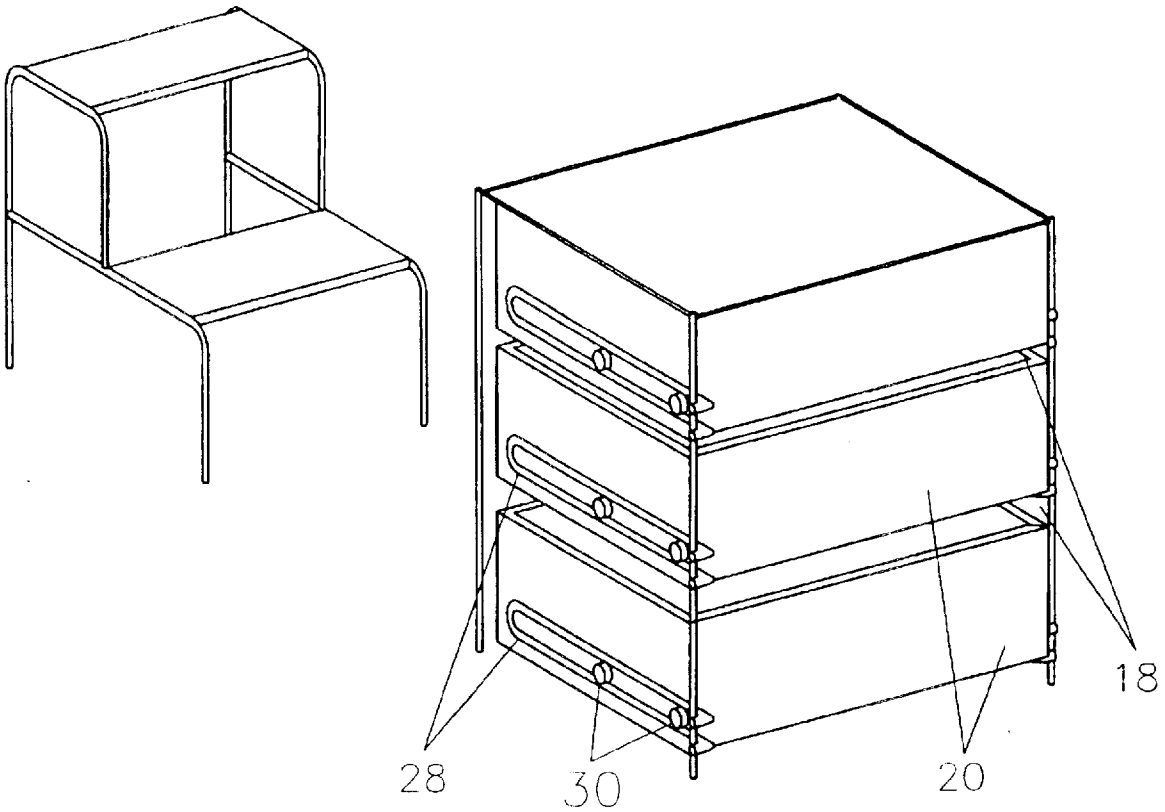
FIG. 14 is a rear trimetric view of an embodiment similar to FIG. 9 showing the relative positions of the step stool or ladder of the invention and the table or shelving system of the invention with the step stool/ladder in an unstowed position.

Referring to FIGS. 9 and 14 another option can be appreciated. In the previous figures shelving was contemplated, FIGS. 9 and 14, however, illustrate that drawers 20 can be substituted for the shelves, as long as some provisions are made. A clearance slot between the drawers indicated generally by 18 allows the steps to vertically clear the drawers 20, so the step-stool/ladder now fits about the drawers. While FIG. 9 generally depicts drawers with under mount slides, FIG. 14 shows side mount slides. The novel approach used to construct slides in FIG. 14 could be used for either side-mount or under mount slides. The support structure for the drawers 28 forms slides for the drawer in conjunction with the bearing elements 30 which are part of or added to the drawer unit. The front bearing element also serves as a stop for the drawer. Such a bearing element could be as simple as a block or alternatively a wheel. Or, conventional slides could be incorporated into the design.

Figure 10:
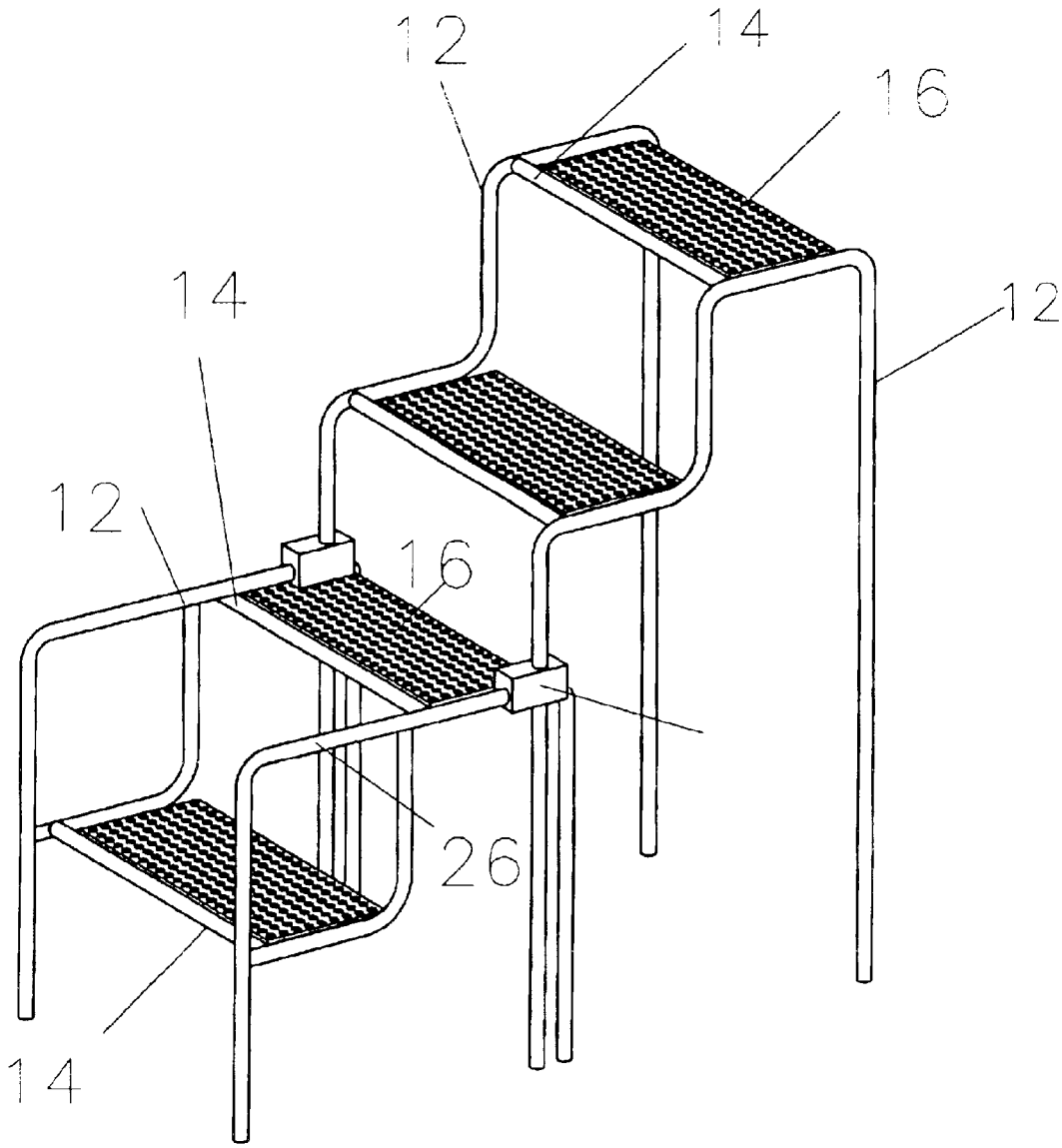
FIG. 10 is a trimetric view of another contemplated embodiment showing a step stool or ladder of the invention, which is expandable in nature to facilitate a more out of use position.
Figure 11:
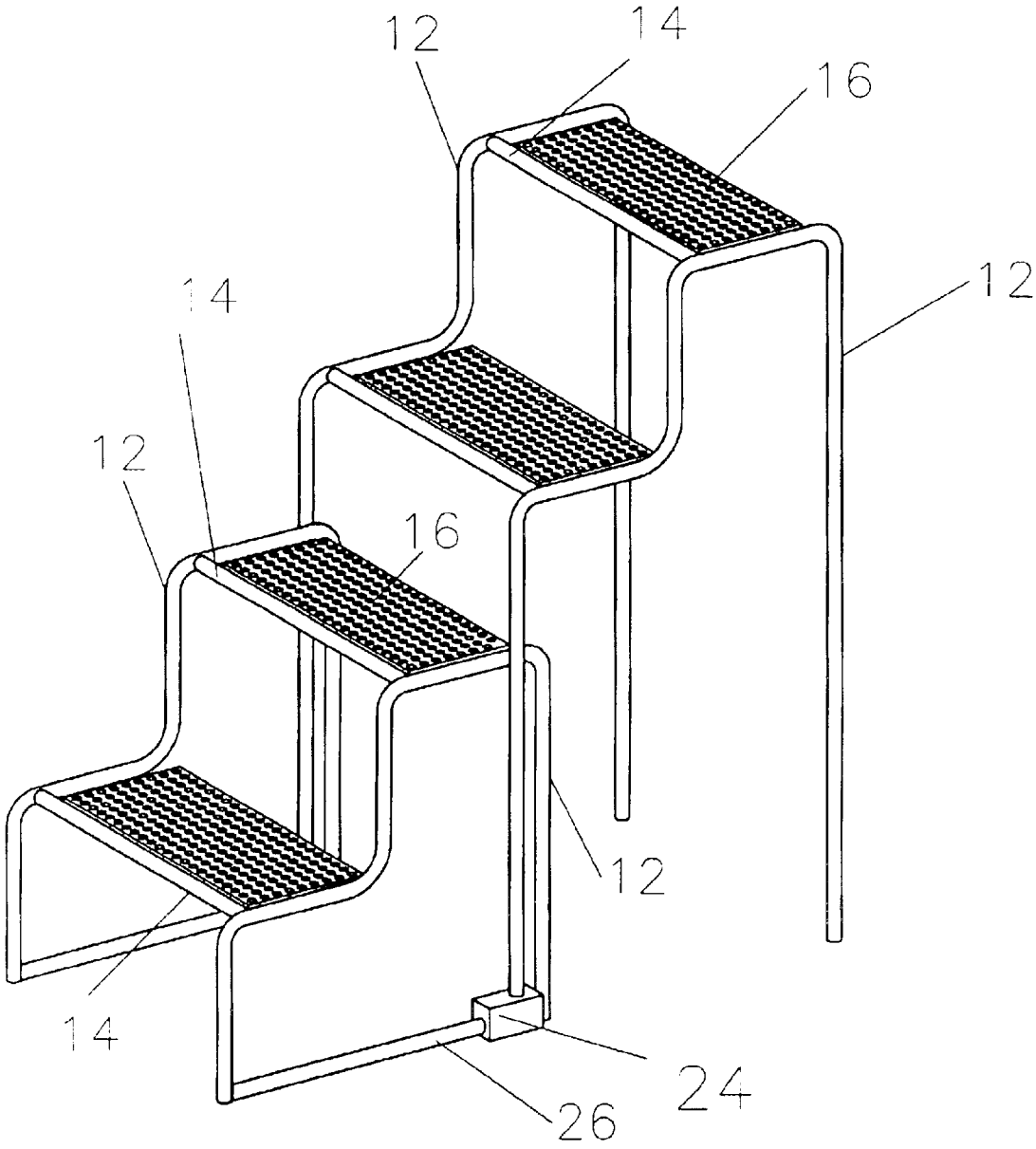
FIG. 11 is a trimetric view of another contemplated embodiment showing another step stool or ladder of the invention, which is expandable in nature to facilitate a more out of use position.

Referring to FIGS. 10 and 11, another option concerning the step-stool ladder can be appreciated. Both these figures show a step-stool ladder that is expandable so the step-stool ladder when used alone or with the aforementioned table/shelving system takes up less space when it is to be stored. The primary difference between FIGS. 10 and 11 is the relative location of the sliding blocks 24. Block 24 is allowed to slide on rail 26, allowing two sets of steps to nest and thus fit into the depth normally used for one set of steps. Blocks and rails are depicted, however, any type of sliding/telescoping structures could be used. In both cases an increment of two steps is used, however, any number (increment) or total number of steps can be collapsed in this manner. In the situation where these steps are used with an associated table/ shelving system it allows step units to be as tall as needed (and the associated table/shelving/drawer units can have a plurality of storage spaces) without having to increase the depth of the table/shelving/drawers to accommodate the stowed depth of the step-stool ladder. In the case when the step-stool ladder is used alone, the stored depth of it is obviously also reduced. It should also be noted that one of the known conventional folding formats, such as pivot points, for a step-stool-ladder could also be used.

All of the previous embodiments use a two-step ladder, and a few shelves or drawers. It should be appreciated that any number of steps or shelves can be configured as disclosed to work.

Figure 12:
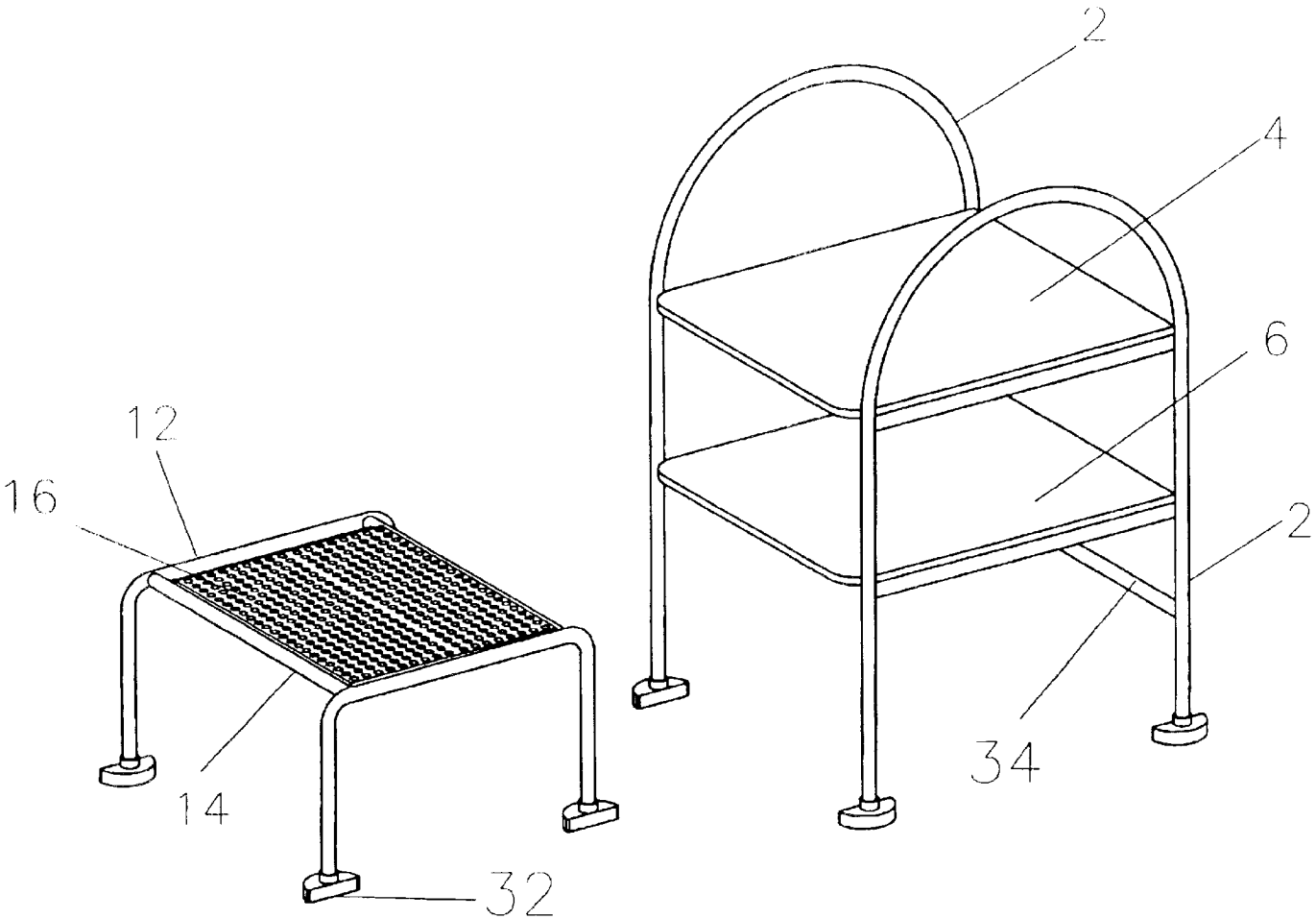
FIG. 12 is a trimetric view of another contemplated embodiment showing the relative positions of the step stool or ladder of the invention and the table or shelving system of the invention before stowage of the step-stool ladder.
Figure 13:
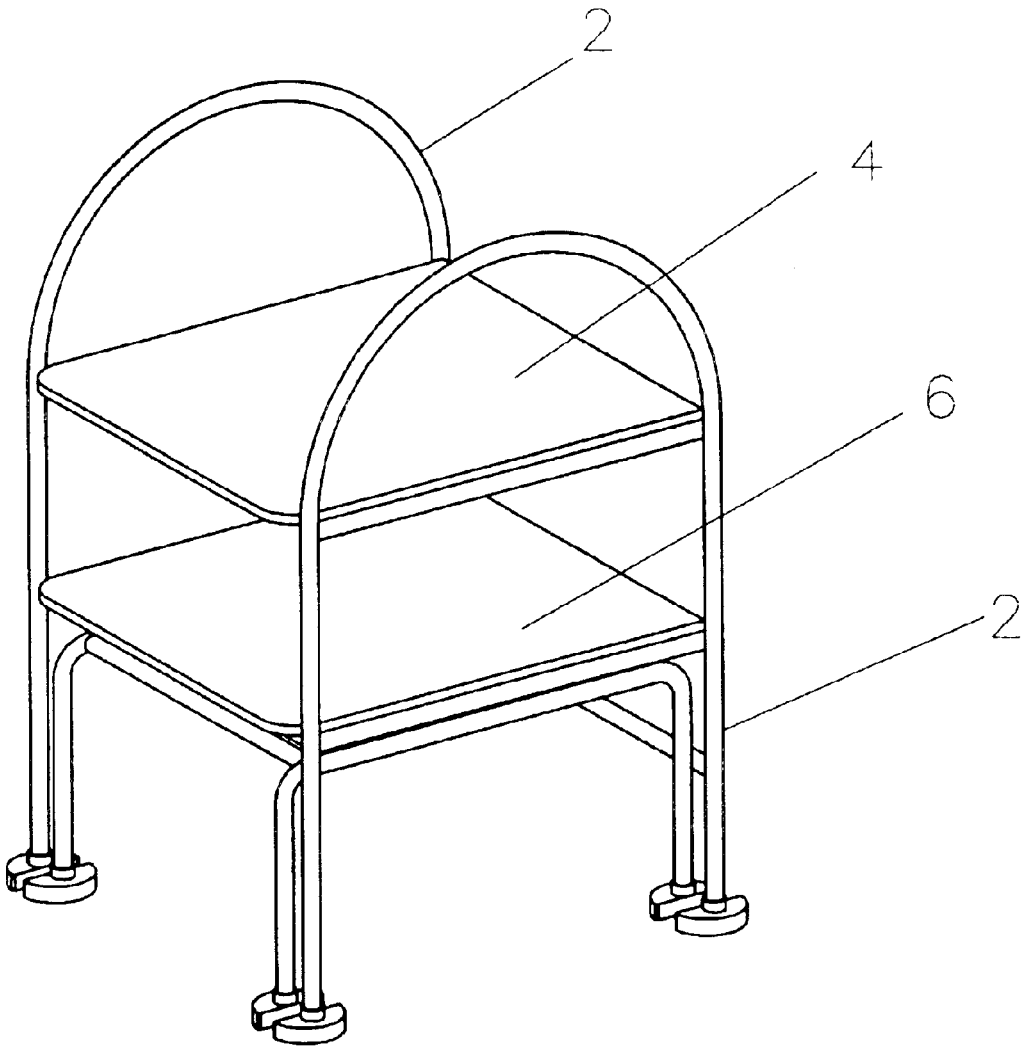
FIG. 13 is a trimetric view similar to FIG. 12 showing the relative positions of the step stool or ladder of the invention and the table or shelving system of FIG. 12 with the step stool/ladder in a stowed or out of use position.

FIG. 12 shows a simplification over the previous embodiments. In it is depicted a step stool ladder that is sized and aesthetically designed to fit neatly completely under a shelving system. In this case, the cantilevered shelves are not necessary, however, the number of steps of the step-stool ladder and/or the number of shelves on the table shelving system are more restrictive. Of note are the feet 32, and the limit or stop bar 34. Stops have been previously been discussed but will be reiterated with reference to FIGS. 12 and 13. The feet are designed to form a completed shape when the units are combined. In other words, when the step stool is in its stowed position. FIG. 13 shows that, when the stool is placed under the shelving system, the feet and all vertical supports of both the step stool and the table are aligned automatically when the stool strikes the limit stop 34, best seen by referring to FIG. 12 or FIG. 15. Such a limit or stop could be placed in a variety of positions on either the step stool or the shelving-storage unit. And so it should be appreciated that even when cantilevered shelves are not required, it is desirable to provide alignment and design elements that make the units aesthetically pleasing and efficient when they are used together.

All of the aforementioned options, stops, feet, cantilevered shelves; cantilevered shelves, solid sides, drawers, etc. may be applicable to all presented embodiments. So it should be appreciated that the table/shelf/drawer unit and its corresponding step stool/ladder or other storage structure could be constructed in many ways, materials and forms, and additionally many combinations of the basic elements and features are possible and fall within the spirit and scope of the invention.

I claim:

1. Cooperating furniture structures comprising:

a) a first storage structure comprising a normally generally vertical support member and a normally generally horizontal surface having first and second opposed side edges and cantilevered from said vertical support member, b) a second structure comprising a normally generally horizontal support surface and at least two spaced apart support members supporting said horizontal support surface, where said second structure fits within said first storage structure, and c) a stop for locating and stopping said second structure at a specific point within said first storage structure.

2. The cooperating furniture structures of claim 1, said first storage structure further comprising a second normally generally horizontal surface that is disposed at a level different from the first horizontal surface of said first storage structure, is supported by said vertical support member, and has first and second opposed side edges.

3. The cooperating furniture structures of claim 2, where the second horizontal surface of said first storage structure comprises a bottom wall of a drawer.

4. The cooperating furniture structures of claim 3, where said drawer is supported by at least one drawer slide cantilevered from said generally vertical support member, whereby said drawer may be easily accessed.

5. The furniture structure of claim 2, where said first structure further comprises first and second sides opposing, and spaced further apart than, the first and second side edges of said first and second horizontal surfaces.

6. The furniture structure of claim 5, further comprising a first clearance slot defined between the first side of said first structure and the first sides of said first and second horizontal surfaces and a second clearance slot defined between the second side of said first structure and the second sides of said first and second horizontal surfaces.

7. The furniture structure of claim 6, where said vertical support member and at least one of said sides of said first structure are an integral member.

8. The furniture structure of claim 7, where said integral member is an L-cross-section column.

9. The cooperating furniture structures of claim 1, where the horizontal surface of said first storage structure has a width that is narrower than the distance between the spaced apart support members of said second structure.

10. The cooperating furniture structures of claim 5, further comprising a clearance slot between the horizontal surface and the vertical support member of said first storage structure.

11. Cooperating furniture structures comprising:

a) a first storage structure having first and second normally generally horizontal surfaces and a normally generally vertical support member supporting said horizontal surfaces, in which said second horizontal surface has first and second opposed side edges and is cantilevered from said support member, where the first side edge of said second horizontal surface is spaced inward from and forms a clearance slot with said vertical support member, b) a second structure having a normally generally horizontal support surface and first and second support members supporting the horizontal support surface of said second structure, in which the first and second opposed side edges of said second horizontal surface of said first storage structure are closer together than the first and second support members of said second structure, so said second structure may nest with said first storage structure, and so the horizontal support surface of said second structure is disposed above the second horizontal surface of said first structure when said second structure is nested with said first storage structure.

12. The cooperating furniture structures of claim 11, where said second structure is a step stool.

13. The cooperating furniture structures of claim 11, where said second structure further comprises a second normally generally horizontal surface.

14. The cooperating furniture structures of claim 11, where said second structure is a second storage structure.

15. The cooperating furniture structures of claim 14, where said second structure further comprises a second normally generally horizontal surface.

16. Cooperating furniture structures comprising:

a) a first storage structure having at least first and second normally generally horizontal surfaces, at least the second of which is a bottom wall of a drawer, at least one normally generally vertical support member supporting said horizontal surfaces, and a drawer slide cantilevered from said support member for supporting said drawer, b) a second structure having at least one normally generally horizontal support surface and at least two support members supporting said horizontal support surface, c) where said drawer fits between said support members of said second structure, d) where said second structure may nest with said first storage structure with the horizontal support surface of said second structure disposed above said drawer.

17. The cooperating furniture structures of claim 16, where said second structure is a step stool.

18. The cooperating furniture structures of claim 17, where said second structure further comprises a second normally generally horizontal surface.

19. The cooperating furniture structures of claim 16, where said second structure further comprises a second normally generally horizontal surface.

20. The cooperating furniture structures of claim 16, where said second structure is a second storage structure.

21. The cooperating furniture structures of claim 20, where said second structure further comprises a second normally generally horizontal surface.

22. The cooperating furniture structures of claim 16, further comprising a clearance slot between said drawer and said vertical support member of said first storage structure.

23. Cooperating furniture structures comprising:

a. a first storage structure comprising first and second opposed normally generally vertical side members and a normally generally horizontal surface having first and second opposed side edges inwardly spaced from and disposed between said side members, where the spaces between said side members and said edges and above said horizontal surface define a generally U-shaped clearance channel; and b. a second structure comprising a normally generally horizontal support surface and at least two spaced apart support members supporting said horizontal support surface, said second structure being generally U-shaped and sized to enter and fit within said U-shaped clearance channel.

* * * * *